US010056028B2

(12) United States Patent
Yamamoto

(10) Patent No.: US 10,056,028 B2
(45) Date of Patent: Aug. 21, 2018

(54) DISPLAY UNIT AND ELECTRONIC APPARATUS

(71) Applicant: JOLED Inc., Tokyo (JP)

(72) Inventor: Tetsuro Yamamoto, Tokyo (JP)

(73) Assignee: JOLED Inc., Tokyo (JP)

( * ) Notice: Subject to any disclaimer, the term of this patent is extended or adjusted under 35 U.S.C. 154(b) by 5 days.

(21) Appl. No.: 15/348,846

(22) Filed: Nov. 10, 2016

(65) Prior Publication Data

US 2017/0140700 A1 May 18, 2017

(30) Foreign Application Priority Data

Nov. 13, 2015 (JP) ..... 2015-222716

(51) Int. Cl.
*G09G 3/30* (2006.01)

(52) U.S. Cl.
CPC ..... *G09G 3/30* (2013.01); *G09G 2320/043* (2013.01); *G09G 2330/021* (2013.01)

(58) Field of Classification Search
None
See application file for complete search history.

(56) References Cited

U.S. PATENT DOCUMENTS

2015/0187277 A1 7/2015 Maeyama et al.
2016/0070386 A1* 3/2016 Yamamoto ..... G06F 3/044 345/174
2017/0221411 A1* 8/2017 Chang ..... G09G 3/2096

FOREIGN PATENT DOCUMENTS

JP 2015-125356 A 7/2015

* cited by examiner

*Primary Examiner* — Amr Awad
*Assistant Examiner* — Andre Matthews
(74) *Attorney, Agent, or Firm* — Michael Best & Friedrich LLP

(57) ABSTRACT

A display unit includes a plurality of pixels and a drive circuit. The plurality of pixels each includes a light emitting device, a transistor, and a capacitor. The drive circuit writes an image signal into each of the pixels and thereby performs display drive. The pixels as a whole are dividable into a plurality of pixel groups. The drive circuit performs intermittent stopping of the display drive for the respective pixel groups independently of each other in a still image display period based on the image signal.

8 Claims, 9 Drawing Sheets

MODIFICATION 2

DISPLAY UNIT AND ELECTRONIC APPARATUS

CROSS REFERENCE TO RELATED APPLICATIONS

This application claims the benefit of Japanese Priority Patent Applications JP2015-222716 filed Nov. 13, 2015, the entire contents of which are incorporated herein by reference.

BACKGROUND

The disclosure relates to a display unit with a plurality of pixels each including a light emitting device and relates to an electronic apparatus with such a display unit.

Various types of display units each including a light emitting device such as an organic electro luminescence (EL) devices have been proposed (e.g., refer to Japanese Unexamined Patent Application Publication No. 2015-125356).

SUMMARY

Typically, there have been demands for display units to suppress lowering of display image quality, or to improve display quality, and to reduce its power consumption. Therefore, proposals of techniques for accomplishing these demands are expected.

It is desirable to provide a display unit and an electronic apparatus that each make it possible to reduce its power consumption while suppressing lowering of display image quality.

A display unit according to one embodiment of the disclosure includes a plurality of pixels and a drive circuit. The plurality of pixels each include a light emitting device, a transistor, and a capacitor. The drive circuit writes an image signal into each of the pixels and thereby performs display drive. The pixels as a whole are dividable into a plurality of pixel groups. The drive circuit performs intermittent stopping of the display drive for the respective pixel groups independently of each other in a still image display period based on the image signal.

An electronic apparatus according to one embodiment of the disclosure includes a display unit. The display unit includes a plurality of pixels and a drive circuit. The plurality of pixels each includes a light emitting device, a transistor, and a capacitor. The drive circuit writes an image signal into each of the pixels and thereby performs display drive. The pixels as a whole are dividable into a plurality of pixel groups. The drive circuit performs intermittent stopping of the display drive for the respective pixel groups independently of each other in a still image display period based on the image signal.

DETAILED DESCRIPTION

Some embodiments of the disclosure will be described in detail with reference to the accompanying drawings. The description will be given in the following order.

1. Embodiment (an example of performing intermittent stopping of display drive alternately for odd-numbered rows and even-numbered rows).
2. Modifications Modification 1 (an example of performing intermittent stopping of display drive on a plurality of pixels as a whole in a constant cycle)

Modification 2 (an example of adjusting a light-emission period using light-emission control switches in respective pixels)

3. Exemplary applications (exemplary applications of display units according to the embodiment and Modifications 1 and 2 to electronic apparatuses).
4. Other Modifications

1. EMBODIMENT

Configuration

Figure 1:
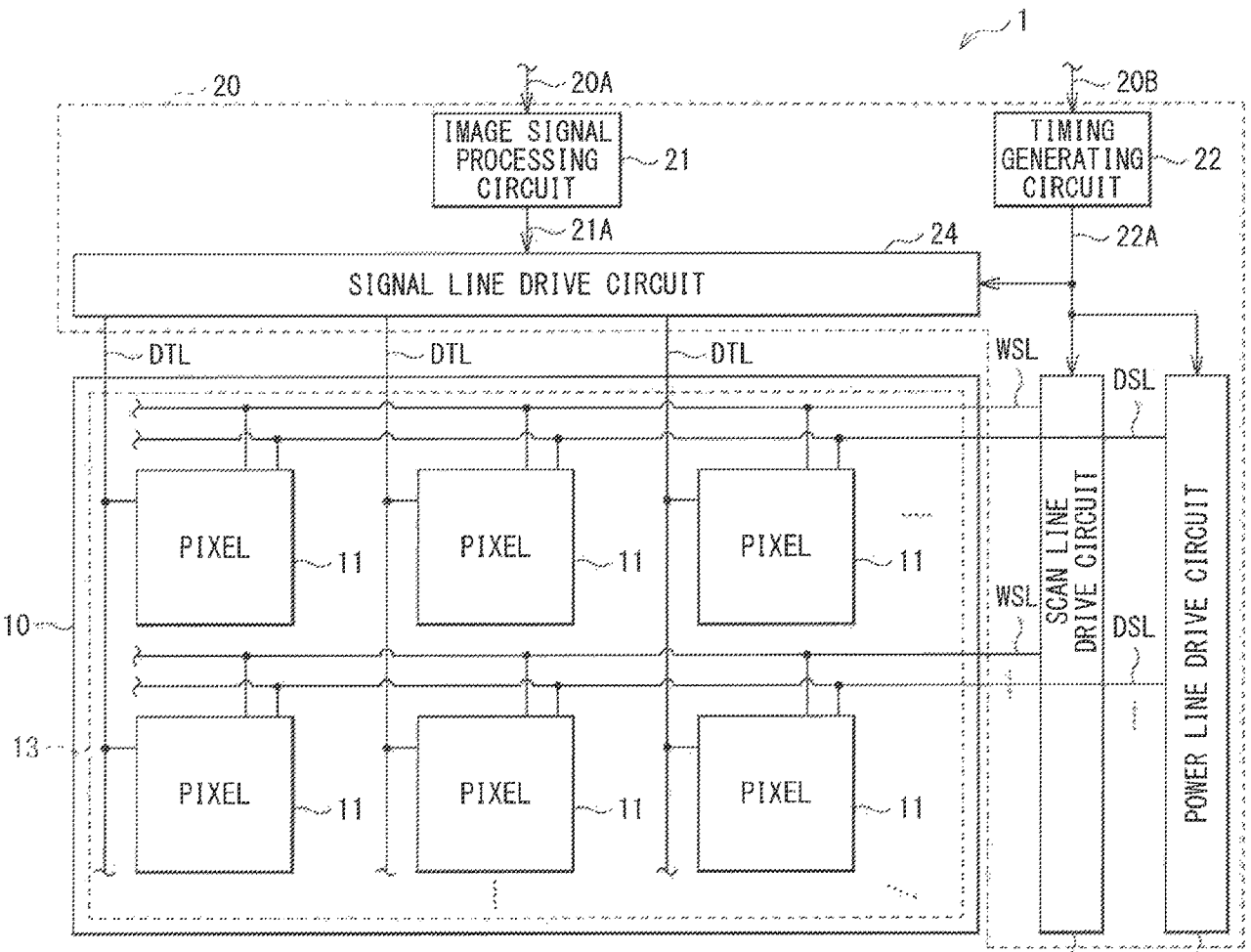
FIG. 1 is a block diagram illustrating an exemplary outline configuration of a display unit according to an embodiment of the disclosure.

FIG. 1 is a block diagram illustrating an outline configuration of a display unit (a display unit 1) according to one embodiment of the disclosure. The display unit 1 may include a display panel 10 serving as a display section, and a drive circuit 20.

(Display Panel 10)

The display panel 10 includes a pixel array 13 in which a plurality of pixels 11 are arranged in a matrix fashion. The display panel 10 displays an image by active-matrix drive on the basis of an image signal 20A and a synchronization signal 20B that are to be received from the outside.

Examples of the pixels 11 may include three types of pixels; a pixel 11 for red display, a pixel 11 for green display, and a pixel 11 for blue display, which are also referred, respectively, to as a red pixel, a green pixel, and a blue pixel. However, the pixels 11 are not limited to these three types of pixels. Alternatively, for example, the pixels 11 may have a single type, two types, or four or more types. For example, the single type of pixels may be pixels for monochrome display. The four types of pixels may be a red pixel, a green pixel, a blue pixel, and a white pixel.

The pixel array 13 may include a plurality of scan lines WSL, a plurality of signal lines DTL, and a plurality of power lines DSL. The scan lines WSL each extend in a horizontal direction and are arranged in rows. The signal lines DTL each extend in a vertical direction and are arranged in columns. Hereinafter, the horizontal direction is also referred to as the H direction, and the vertical direction is also referred to as the V direction. The power lines DSL are arranged in rows along the scan lines WSL. First ends of these scan lines WSL, signal lines DTL, and power lines DSL are coupled to the drive circuit 20, which will be described later. The above-described pixels 11 are disposed at corresponding intersections of the scan lines WSL and the signal lines DTL so as to form a matrix shape.

Figure 2:
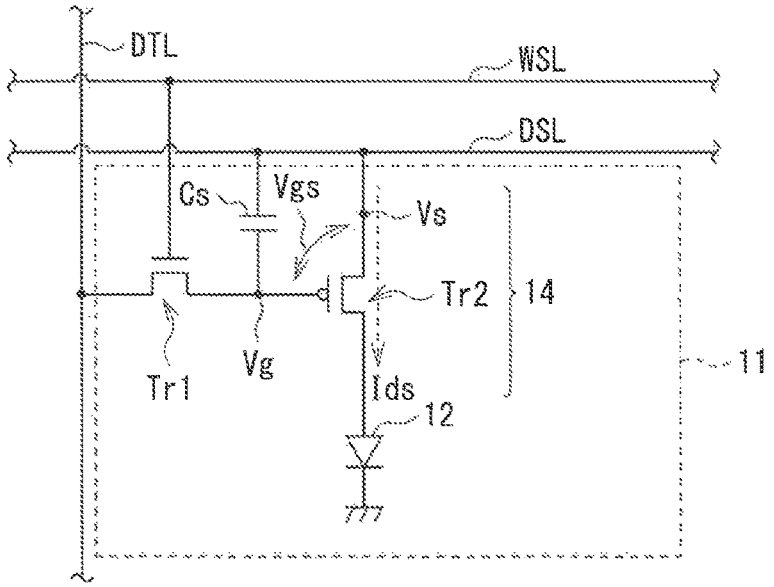
FIG. 2 is a circuit diagram illustrating an exemplary internal configuration of each pixel illustrated in FIG. 1.

FIG. 2 is a circuit diagram illustrating an exemplary internal configuration of each of the pixels 11. Each of the pixels 11 may include an organic EL device (an organic electroluminescence light emitting device) 12 and a pixel circuit 14. In this example, the organic EL device 12 may correspond to a "light emitting device" in one specific but non-limiting embodiment of the disclosure.

The pixel circuit 14 may include a write (sampling) transistor Tr1 (a first transistor), a drive transistor Tr2 (a second transistor), and a capacitor Cs. In short, the pixel circuit 14 has a so-called "2Tr1C" circuit configuration. In this example, the write transistor Tr1 may be an n-channel MOS (metal oxide semiconductor) TFT (thin film transistor), and the drive transistor Tr2 may be a p-channel MOS TFT. However, neither the write transistor Tr1 nor the drive transistor Tr2 is limited to a specific type of TFT. Alternatively, for example, each of the write transistor Tr1 and the drive transistor Tr2 may employ an inversely staggered structure, or a so-call bottom gate type, or may employ a staggered structure, or a so-called top gate type.

In this example, the write transistor Tr1 and the drive transistor Tr2 may each correspond to a "transistor" in one specific but non-limiting embodiment of the disclosure.

In the pixel circuit 14, a gate of the write transistor Tr1 is coupled to the scan line WSL, whereas a drain of the write transistor Tr1 is coupled to the signal line DTL. In addition, a source of the write transistor Tr1 is coupled to both a gate of the drive transistor Tr2 and a first end of the capacitor Cs. Both a second end of the capacitor Cs and a source of the drive transistor Tr2 are coupled to the power line DSL, whereas a drain of the drive transistor Tr2 is coupled to an anode of the organic EL device 12. A cathode of the organic EL device 12 is set to a fixed potential. In this example, the cathode of the organic EL device 12 is coupled to a ground line and thereby grounded (set to a ground potential). The cathode of the organic EL device 12 serves as a common electrode of the respective organic EL devices 12. For example, the cathode of the organic EL device may be a planar electrode continuously formed over a display region of the display panel 10.

(Drive Circuit 20)

The drive circuit 20 is a circuit that drives the pixel array 13 (the display panel 10). In other words, the drive circuit 20 performs display drive. Specifically, as will be described in detail later, the drive circuit 20 sequentially selects the pixels 11 in the pixel array 13 while writing image signals into the respective selected pixels 11, thereby performing the display drive on the respective pixels 11. In this example, the image signals may each correspond to an image signal voltage based on the image signal 20A. As illustrated in FIG. 1, the drive circuit 20 may include an image signal processing circuit 21, a timing generating circuit 22, a scan line drive circuit 23, a signal line drive circuit 24, and a power line drive circuit 25.

The signal processing circuit 21 is a circuit that subjects the digital image signal 20A received from the outside to a predetermined correction process and outputs an image signal 21A that has been subjected to the predetermined correction process to the signal line drive circuit 24. Examples of this predetermined correction process may include a gamma correction process and an overdrive correction process.

The timing generating circuit 22 is a circuit that generates a control signal 22A on the basis of the synchronization signal 20B received from the outside and outputs the generated control signal 22A, thereby so controlling the scan line drive circuit 23, the signal line drive circuit 24, and the power line drive circuit 25 as to operate in conjunction with one another.

The scan line drive circuit 23 is a circuit that sequentially applies selection pulses to the respective scan lines WSL in accordance with (in synchronization with) the control signal 22A, and thereby sequentially selects the pixels 11. More specifically, the scan line drive circuit 23 selectively outputs a voltage Von and a voltage Voff to generate the above-described selection pulses. The voltage Von is to be applied to turn on the write transistors Tr1, and the voltage Voff is to be applied to turn off the write transistors Tr1. It is to be noted that the voltage Von may have a value (a constant value) equal to or higher than an ON-voltage of the write transistor Tr1, and the voltage Voff may have a value (a constant value) lower than the ON-voltage of the write transistor Tr1.

The signal line drive circuit 24 is a circuit that generates an analog image signal in accordance with (in synchronization with) the control signal 22A, and applies the generated image signal to each of the signal lines DTL. The analog image signal corresponds to the image signal 21A supplied from the image signal processing circuit 21. More specifically, the signal line drive circuit 24 applies an analog image signal voltage based on the image signal 21A to each of the signal lines DTL, thereby writing the image signal into the target pixel 11 selected by the scan line drive circuit 23. The expression "writing the image signal" may refer to applying a predetermined voltage between the gate and the source of the drive transistor Tr2.

Further, the signal line drive circuit 24 is allowed to output two kinds of voltages, i.e., an image signal voltage Vsig based on the image signal 20A and a reference voltage Vofs. The signal line drive circuit 24 alternately applies the image signal voltage Vsig and the reference voltage Vofs to each of the signal lines DTL on a one horizontal (H) period (1H) basis. The reference voltage Vofs is a voltage to be applied to the gate of the drive transistor Tr2 when the organic EL device 12 emits no light. More specifically, the reference voltage Vofs is so set to a voltage value (a constant value) that a voltage value (Vofs−Vth) that is the difference between the reference voltage Vofs and a threshold voltage Vth of the drive transistor Tr2 is less than a voltage value (Vthel+Vcat) that is the sum of a threshold voltage Vthel of the organic EL device 12 and a cathode voltage Vcat of the organic EL device 12.

The power line drive circuit 25 sequentially applies control pulses to the respective power lines DSL in accordance with (in synchronization with) the control signal 22A, and thereby controls a light-emission operation and a non-light-emission operation of each of the organic EL devices 12. More specifically, the power line drive circuit 25 selectively outputs a voltage Vcc and a voltage Vini to generate the above-described control pulses. The voltage Vcc is to be applied to feed a current Ids to the drive transistor Tr2, and the voltage Vini is to be applied to not feed the current Ids to the drive transistor Tr2. Details of current Ids will be described later. In this example, the voltage Vini may be set to a constant voltage value that is lower than a voltage value (Vthel+Vcat) that is the sum of the threshold voltage Vthel and the cathode voltage Vcat of the organic EL device 12. The voltage Vcc may be set to a constant voltage value that is equal to or higher than the voltage value (Vthel+Vcat).

Operation, Workings, and Effects

A. Basic Operation

In the display unit 1, as illustrated in FIG. 1, the drive circuit 20 performs the display drive on each of the pixels 11 in the display panel 10, more specifically in the pixel array 13, based on the image signal 20A and the synchronization signal 20B. Accordingly, a drive current is supplied to the organic EL device 12 in each of the pixels 11, in which holes and electrons are recoupled to cause the organic EL device 12 to emit light. As a result, the display panel 10 displays an image on the basis of the image signal 20A.

More specifically, referring to FIG. 1 and FIG. 2, the display panel 10 performs an operation of writing an image signal, or a display operation, in the following manner.

First, the scan line drive circuit 23 increases a voltage of the scan line WSL from the voltage Voff to the voltage Von in a period in which a voltage of the signal line DTL is set to the image signal voltage, and a voltage of the power line DSL is set to a voltage VH. In response to this, the write transistor Tr1 is turned on, and a gate potential Vg of the drive transistor Tr2 increases to the image signal voltage corresponding to the voltage of the signal line DTL at this time. As a result, the image signal voltage is written into and retained in the capacitor Cs.

The anode voltage of the organic EL device 12 at this time is still lower than a voltage value (Vthel+Vcat) that is the sum of a threshold voltage Vthel of the organic EL device 12 and the cathode voltage Vcat which is equal to the ground potential. Thus, the organic EL device 12 is in a cut-off state in this phase. In other words, no current flows between the anode and the cathode of the organic EL device 12, and therefore the organic EL device 12 emits no light. Accordingly, the current Ids supplied from the drive transistor Tr2 flows through an unillustrated device capacitor present in parallel between the anode and the cathode of the organic EL device 12, so that the device capacitor is charged.

Thereafter, during a period in which the voltage of the signal line DTL is retained at the image signal voltage and the voltage of the power line DSL is retained at the voltage VH, the scan line drive circuit 23 decreases the voltage on the scan line WSL from the voltage Von to the voltage Voff. In response to this, the write transistor Tr1 is turned off, and the gate of the drive transistor Tr2 therefore enters a floating state. Accordingly, the current Ids flows between the drain and the source of the drive transistor Tr2 while the gate-source voltage Vgs of the drive transistor Tr2 is kept constant. As a result, the source potential Vs of the drive transistor Tr2 increases. In relation to this, the gate potential Vg of the drive transistor Tr2 also increases due to capacitance coupling via the capacitor Cs. Accordingly, the anode voltage of the organic EL device 12 becomes higher than the voltage value (Vthel+Vcat) that is the sum of the threshold voltage Vthel and the cathode voltage Vcat of the organic EL device 12. In response thereto, the current Ids according to the image signal voltage retained in the capacitor Cs, namely, the current Ids according to the gate-source voltage Vgs of the drive transistor Tr2, flows between the anode and cathode of the organic EL device 12. Consequently, the organic EL device 12 emits light at a desired luminance.

The drive transistor Tr2 is set to operate within a saturation region in the light-emission period of the organic EL device 12 described above. Therefore, the above-described current Ids flowing through the drive transistor Tr2 and the organic EL device 12 is expressed by the following expression (1). In other words, the drive transistor Tr2 serves as a constant current source that feeds the current Ids having the value expressed by the expression (1).

$$Ids=(1/2)\times\mu\times(W/L)\times Cox\times(Vgs-Vth)^2 \quad (1)$$

where μ denotes mobility of the drive transistor Tr2, W denotes a channel width of the drive transistor Tr2, L denotes a channel length of the drive transistor Tr2, Cox denotes a capacitance per unit area of a gate oxide film in the drive transistor Tr2, Vgs denotes the gate-source voltage (see FIG. 2) of the drive transistor Tr2, and Vth denotes the threshold voltage of the drive transistor Tr2.

Figure 3:
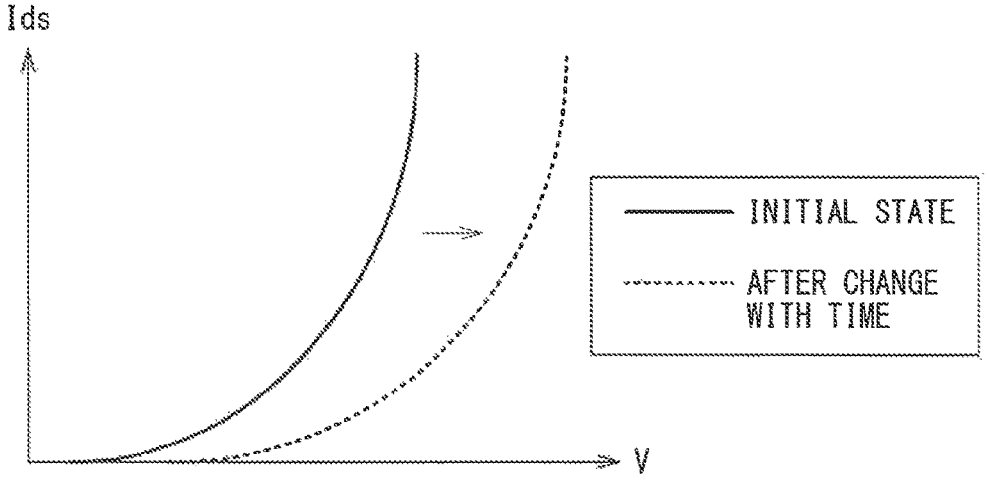
FIG. 3 is a characteristic diagram for describing degradation with time of I-V characteristics of a display unit.

In the pixel circuit 14, as illustrated in FIG. 3, for example, the drain voltage of the drive transistor Tr2 may vary in accordance with a factor such as degradation with time of the I-V characteristics of the organic EL device 12. However, since the gate-source voltage Vgs of the drive transistor Tr2 is kept constant, a constant amount of current Ids flows through the organic EL device 12. Accordingly, a variation in light-emission luminance of the organic EL device 12 is suppressed.

Thereafter, after a predetermined period has passed, the drive circuit 20 terminates the light-emission period of the organic EL device 12. More specifically, the power line drive circuit 25 decreases the voltage of the power line DSL from the voltage VH to the voltage VL. In response to this, the source potential Vs of the drive transistor Tr2 decreases. As a result, the anode voltage of the organic EL device 12 becomes lower than the voltage value (Vthel+Vcat) that is the sum of the threshold voltage Vthel and the cathode voltage Vcat of the organic EL device 12. Accordingly, no current Ids flows between the anode and the cathode of the organic EL device 12. As a result, the organic EL device 12 stops emitting light thereafter. In other words, a non-light-emission period starts.

Thereafter, the drive circuit 20 so performs the display drive that the light-emission operation and the non-light-emission operation described above are repeated in a cycle on a frame period basis (on a one vertical period basis, or on a 1V period basis). Moreover, the drive circuit 20 scans the power lines DSL in a row direction by applying a control pulse to each of the power lines DSL and scans the scan lines WSL in a row direction by applying a selection pulse to each of the scan lines WSL, for example, in each horizontal period (each H period). In this way, the display unit 1 performs the display operation. In other words, the drive circuit 20 performs the display drive.

B. Display Drive Operation Upon Still Image Display

Figure 4:
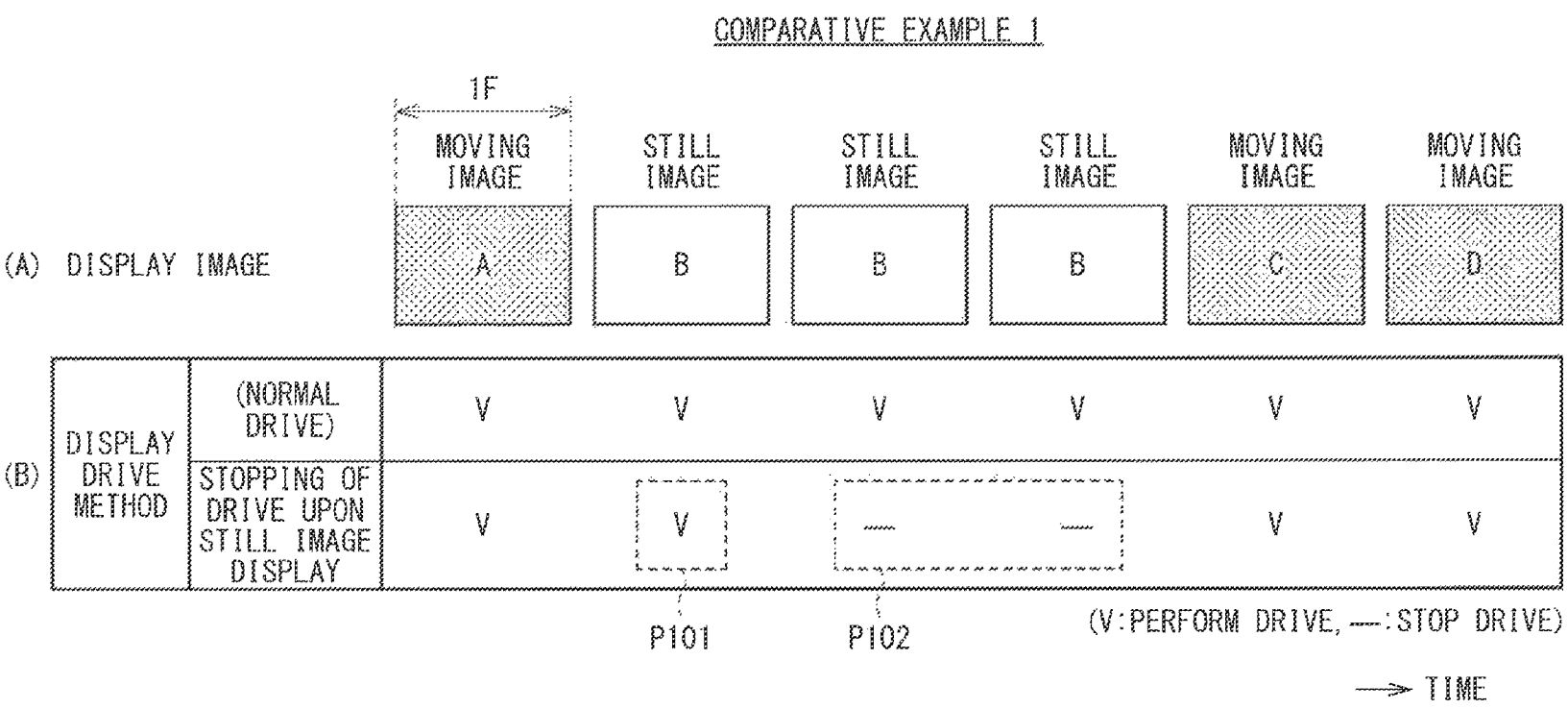
FIG. 4 is a timing diagram schematically illustrating a display drive operation, according to Comparative Example 1, upon displaying a still image.
Figure 5:
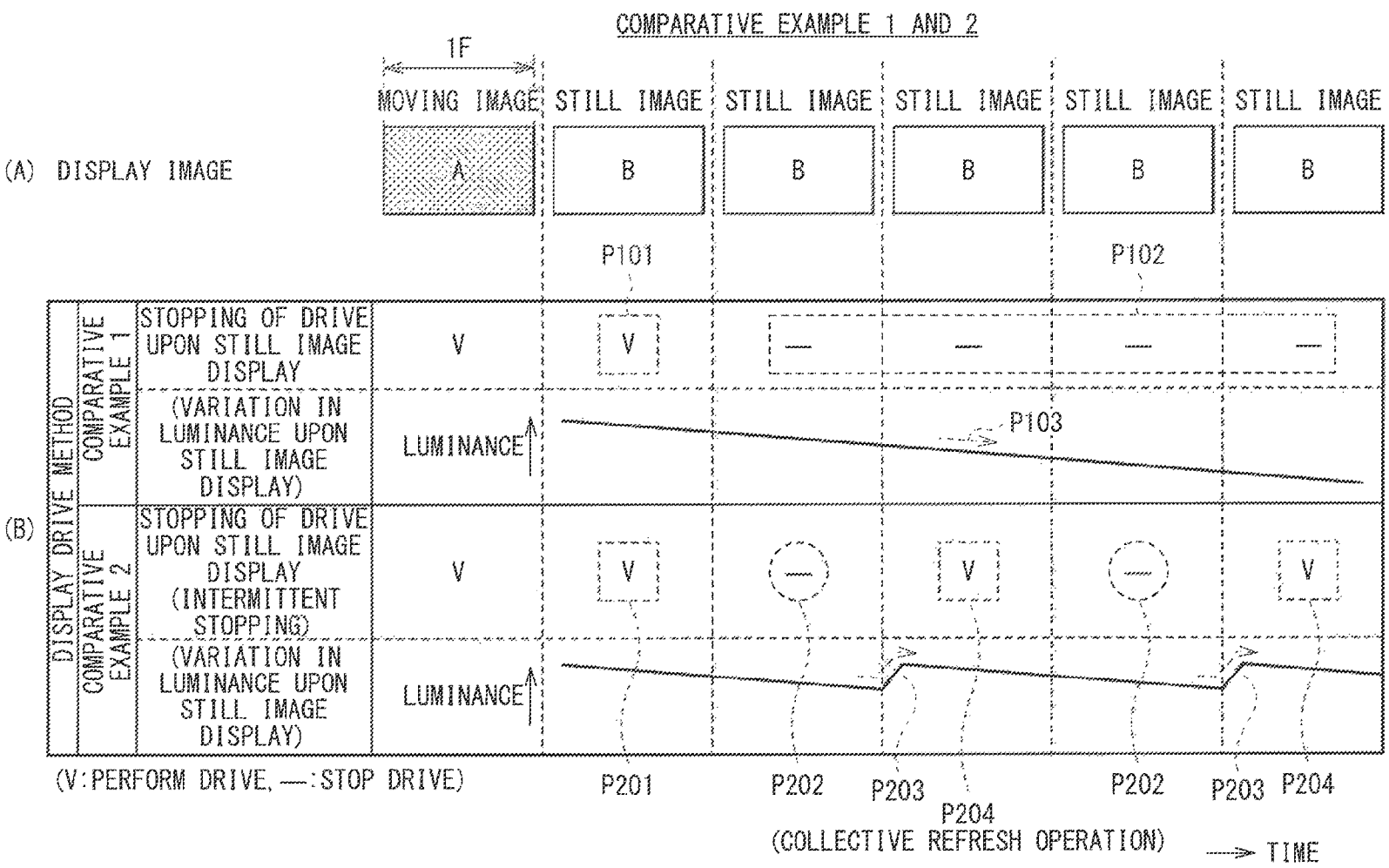
FIG. 5 is a timing diagram schematically illustrating display drive operations, according to Comparative Examples 1 and 2, upon displaying a still image.
Figure 6:
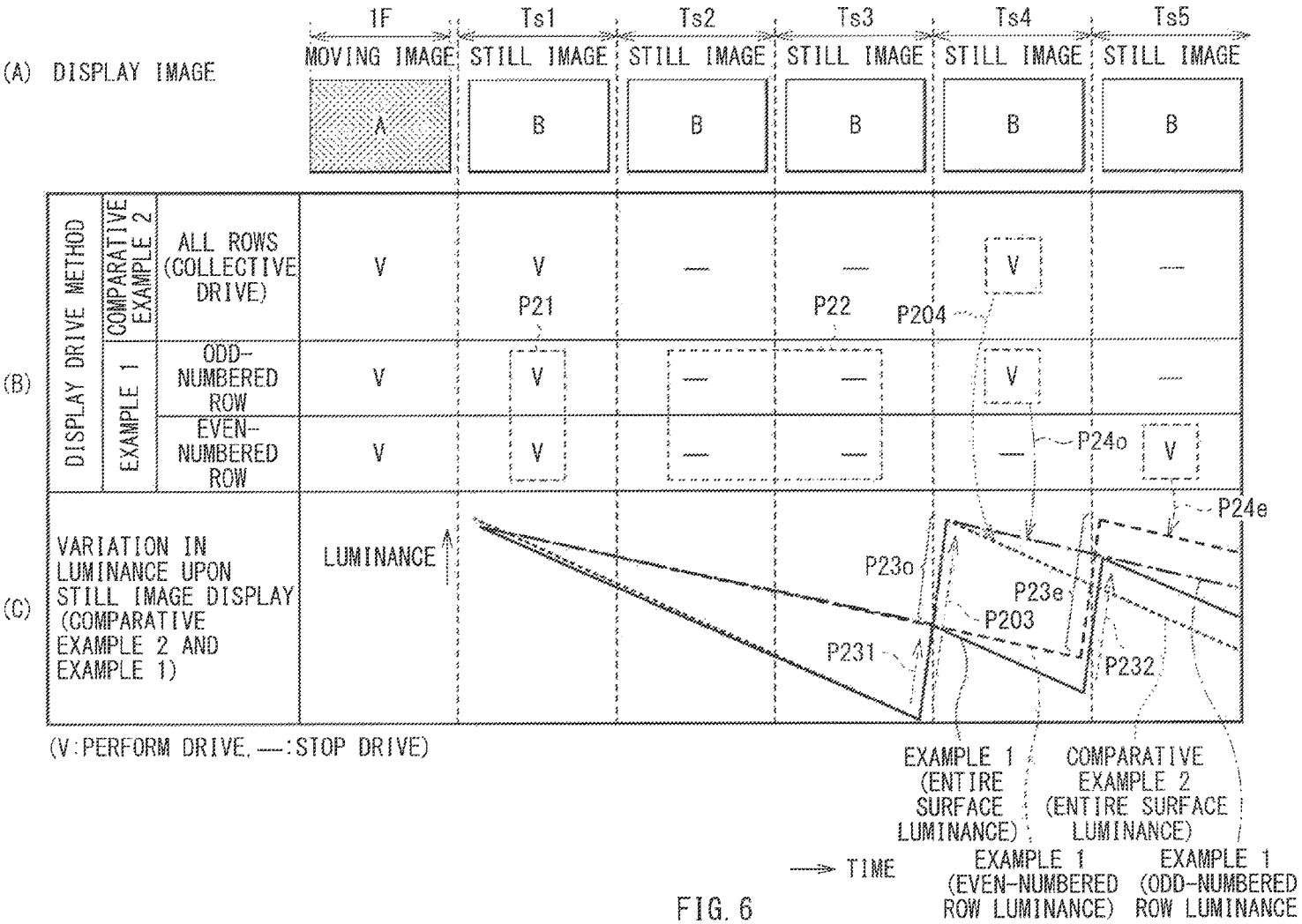
FIG. 6 is a timing diagram schematically illustrating an exemplary display drive operation, according to Example 1 in one embodiment, upon displaying a still image.

A description will be given in detail of an exemplary display drive operation of the display unit 1 upon still image display, with reference to FIG. 1 to FIG. 3 as well as FIG. 4 to FIG. 6, compared to some comparative examples (Comparative Examples 1 and 2).

B-1. Comparative Example 1

FIG. 4 is a timing diagram schematically illustrating a display drive operation upon still image display according to Comparative Example 1. More specifically, Part (A) of FIG. 4 schematically illustrates a change with time in an image displayed on the display panel 10, and Part (B) of FIG. 4 schematically illustrates a display drive method used in each image display period.

In Part (A) of FIG. 4, "1F" denotes one frame period, or one vertical period. This is also applied to the subsequent drawings. In Part (B) of FIG. 4, "V" denotes a period in which display drive is being performed, and "–" denotes a period in which the display drive is stopped. This is also applied to the subsequent drawings.

In Comparative Example 1, the image displayed in each of the frame periods changes in order as a moving image "A", a still image "B", the still image "B", the still image "B", a moving image "C", and a moving image "D".

In this case, when a display drive method for normal drive is used, as illustrated in Part (B) of FIG. 4, the drive circuit 20 continuously performs the display drive, regardless of whether a display image is a moving image or a still image. In other words, the drive circuit 20 continuously performs image display by writing the image signal 21A into each of the pixels 11, regardless of whether a display image is a moving image or a still image.

In the above case, consideration is given to power consumption of the display unit 1 in an image display period, namely, in the light-emission period of the organic EL device 12. The power consumption of the display unit 1 is classified into two types of power consumption, i.e., power consumption that is necessary for light-emission of the organic EL device 12 and power consumption that is necessary for the display drive. The former type of power consumption described above is referred to as "light-emission power consumption", and the latter type of power consumption described above is referred to as "drive power consumption". Of the above-described two types of power consumption, the light-emission power consumption is about zero while the organic EL device 12 is emitting no light, namely, during the non-light-emission period. In contrast, the drive power consumption does not become zero even while the organic EL device 12 is emitting no light, because the display drive is still being performed.

In general, the drive power consumption tends to increase in accordance with an increase in definition, or resolution, of pixels in a display panel. The pixel definitions of some recent display panels have greatly increased to exceed the limitation of visual perception of humans. Therefore, it may be important to reduce this drive power consumption for achieving reduction of power consumption of the display unit 1 as a whole.

To reduce the above-described drive power consumption, the following technique is conceivable. As illustrated in Part (B) of FIG. 4, the drive circuit 20 stops the display drive during the display period of a still image. In other words, the drive circuit 20 stops driving the display panel 10 when the still image is displayed. In this example, the drive circuit 20 stops the display drive during the display period of the still image "B".

More specifically, in the first frame period within the display period of the still image "B", the drive circuit 20 performs the display drive, similarly to the above-described normal drive case, and thereby writes the image signal 21A into each of the pixels 11 (see P101 in Part (B) of FIG. 4). In this example, the foregoing image signal 21A is the image signal corresponding to the still image "B". In the subsequent frame periods (in the second and subsequent frame periods), within the display period of the still images "B", the drive circuit 20 continues to cause image display of the still image "B" to be performed in the following manner. The drive circuit 20 causes the organic EL devices 12 to continuously emit light by using electric charge retained in the capacitors Cs in the respective pixels 11 without performing the above-described display drive (the above-described writing of the image signal 21A).

In this way, the above technique allows for stopping of the display drive when displaying an image identical to an image that has been displayed during the previous frame period. Thus, this technique makes it possible to reduce the drive power consumption when a still image is displayed, thus contributing to reduction of power consumption of the display unit 1 as a whole.

In general, even when a drive circuit stops display drive and as a result, the transistor in each of the pixels is in an OFF state, a small leakage current is flowing in the transistor. This small leakage current may be a cause of a gradual reduction in amount of the electric charge retained in the capacitors in each of the pixels. More specifically, referring to the example in FIG. 2, a leakage current that flows in the drive transistor Tr2 in each of the pixels 11 may cause an amount of electric charge retained in the capacitor Cs to be decreased with time. In other words, the gate-source voltage Vgs of the drive transistor Tr2 may decrease with time. This decrease in the gate-source voltage Vgs may lead to lowering of the light-emission luminance of the organic EL device 12. Accordingly, when the drive circuit 20 stops the display drive for a long time, the light-emission luminance of the organic EL device 12 is gradually lowered due to the leakage current (see an arrow P103 in Part (B) of FIG. 5, which will be described later). This may result in a lowered quality (display image quality) of an image displayed in the display unit 1.

B-2. Comparative Example 2

The drive circuit 20 in Comparative Example 2 does not stop the display drive collectively during the display period of the still image (in all of the second frame period and the subsequent frame periods). Instead, the drive circuit 20 stops the display drive in an intermittent manner. In other words, the drive circuit 20 performs the display drive in some frame periods in which the still image is displayed. In other words, in Comparative Example 2, the display drive is stopped in the display period of the still image but a refresh operation is regularly performed. During this refresh operation, an operation of regularly rewriting electric charge corresponding to an image signal of the still image into the capacitor Cs in each of the pixels 11. Details of the above description will be described later.

FIG. 5 is a timing diagram schematically illustrating a display drive operation according to Comparative Example 2 upon still image display, comparing with that according to Comparative example 1 described above. More specifically, Part (A) of FIG. 5 schematically illustrates a change with time in images displayed in display panel 10, and Part (B) of FIG. 5 schematically illustrates display drive methods in respective Comparative Examples 1 and 2 in each period in which an image is displayed in comparison with each other. Part (B) of FIG. 5 also illustrates variations with time in light-emission luminance of organic EL devices 12 in each of Comparative Examples 1 and 2 in the display period of the still image.

In Comparative Example 2, images displayed in the respective frame periods change in order as a moving image "A", a still image "B", the still image "B", the still image "B", the still image "B", and the still image "B", as illustrated in Part (A) of FIG. 5.

The technique in Comparative Example 1 described above, the display drive is stopped in all of the second frame period and the subsequent frames within the display period of the still image "B" (see P101 and P102 in Part (B) of FIG. 5). Accordingly, the light-emission luminance may be gradually lowered due to the leakage current as described above (see the arrow P103 in Part (B) of FIG. 5).

In contrast, as described above, in the technique in Comparative Example 2, the display drive is stopped in an intermittent manner in the display period of the still image. In other words, the display drive is performed in some of the frame periods. The refresh operation is thereby performed regularly.

Specifically, as illustrated in Part (B) of FIG. 5, the drive circuit 20 performs the display drive in the first frame period within the display period of the still image "B". Thereafter, the drive circuit 20 stops the display drive for each of the pixels 11 in an intermittent manner in the second and subsequent frame periods (see P201, P202, and P204 in Part (B) of FIG. 5). More specifically, the drive circuit 20 stops the display drive in the second and fourth frame periods within the display period of the still image "B" (see P202) but performs the display drive in the third and fifth frame periods (see P204). In this way, the display unit 1 in Comparative Example 2 regularly performs the refresh operation collectively for all of the pixels 11 in the display panel 10. Hereinafter, this refresh operation is referred to as "collective refresh operation".

Regularly performing the above-described collective refresh operation in Comparative Example 2 makes it possible to suppress lowering of light-emission luminance which is attributed to the leakage current, as compared with Comparative Example 1 (see an arrow P203 in Part (B) of FIG. 5).

However, when the display drive for each of the pixels 11 is stopped in an intermittent manner, namely, the collective refresh operation is regularly performed as described above, humans may visually perceive a slight variation in luminance resulted therefrom (see arrow P203) as flickers (blinks) in some cases. For this reason, also in Comparative Example 2, an occurrence of flickers which is attributed to the intermittent stopping of the display drive may lower display image quality. To avoid the occurrence of such flickers, it is difficult to set a long period in which the display drive is stopped when a still image is displayed. In this case, it is also difficult to greatly lower the drive power consumption.

As described above, it is difficult to reduce power consumption while suppressing lowering of display image quality in Comparative Examples 1 and 2.

B-3. Example 1

To address the above-described issue of Comparatives 1 and 2, the display unit 1 according to the present embodiment employs a display drive method that will be described in detail below.

The display unit 1 is designed to allow the plurality of pixels 11 disposed in the display panel 10 as a whole to be divided into a plurality of pixel groups. Each of these pixel groups includes a plurality of pixels 11. The drive circuit 20 does not perform the intermittent stopping of the display drive collectively on all of the pixels 11 in the display panel 10 in the display period of the still image. Instead, the drive circuit 20 performs the intermittent stopping of the display drive for the respective pixel groups independently from each other. In this case, to stop the display drive, namely, to stop writing the image signal 21A, the drive circuit 20 stops the above-described application of the selection pulses to the respective scan lines WSL.

As one example, in Example 1 that will be described below, each of the pixel groups includes a plurality of pixels 11 disposed along one or more scan lines WSL. In other words, each of the pixel groups includes the pixels 11 commonly coupled to the respective one or more scan lines WSL. In Example 1, the drive circuit 20 performs the intermittent stopping of the display drive for the respective one or more scan lines WSL constituting the respective pixel groups independently from each other, in the display period of the still image.

FIG. 6 is a timing diagram schematically illustrating an exemplary display drive operation upon still image display according to Example 1 of the present embodiment, compared with that of Comparative Example 2. Part (A) of FIG. 6 schematically illustrates a change with time in a display image in the display panel 10. Part (B) of FIG. 6 schematically illustrates display drive methods according to Comparative Example 2 and Example 1 used in the respective display periods of the images in comparison with each other. Part (C) of FIG. 6 illustrates variations with time in light-emission luminances of the organic EL devices 12 according to Comparative Example 2 and Example 1 in the display periods of the still images.

As for Example 1, illustration in each of Part (B) and Part (C) of FIG. 6 differentiates the scan lines WSL located in odd-numbered rows and the scan lines WSL located in even-numbered rows from each other, out of the plurality of scan lines WSL disposed in the display panel 10. Thus, the illustration in Part (B) of FIG. 6 differentiates the display drive method used for the odd-numbered rows and the display drive method used for the even-numbered rows from each other. The illustration in Part (C) of FIG. 6 differentiates a variation in light-emission luminance of the odd-numbered rows as a whole and a variation in light-emission luminance of the even-numbered rows as a whole from each other. Furthermore, the illustration in Part (C) of FIG. 6 also includes light-emission luminance of all of the pixels 11 in the display panel 10. Hereinafter, the light-emission luminance of the odd-numbered rows as a whole is referred to as "odd-numbered row luminance". The light-emission luminance of the even-numbered rows as a whole is referred to as "even-numbered row luminance". The light-emission luminance of all of the pixels 11 is referred to as "entire surface luminance". It is to be noted that, in Comparative Example 2, as described above, the display drive method is applied collectively to all of the pixels 11 (all of the rows) disposed in the display panel 10 (see Part (B) of FIG. 6). For this reason, Part (C) of FIG. 6 illustrates only the entire surface luminance for Comparative Example 2.

In this example, the scan lines WSL located in the odd-numbered rows may correspond to a "odd-numbered scan line" in one specific but non-limiting embodiment of the disclosure, and the scan lines WSL located in the even-numbered rows may correspond to "even-numbered scan line" in one specific but non-limiting embodiment of the disclosure.

In this example, images displayed in the respective frame periods change in order as a moving image "A", a still image "B", the still image "B", the still image "B", the still image "B", and the still image "B", as illustrated in Part (A) of FIG. 6. For the sake of convenience in description, the first to fifth frame periods in each which the still image "B" is displayed are hereinafter referred, respectively, as "still image display frame periods Ts1 to Ts5" (see Part (A) of FIG. 6).

In the example of FIG. 6, preconditions are preset as follows. When the drive circuit 20 performs collective stopping of the display drive for two frame periods in total, in other words, when the drive circuit 20 performs stopping of the display drive on all of the pixels 11 for two frame periods in total, it is assumed that humans visually perceive no occurrence of flickers. For example, the foregoing two frame periods may be the still image display frame periods Ts1 and Ts2. When the drive circuit 20 performs collective stopping of the display drive for three frame periods or more in total, it is assumed that humans visually perceive the occurrence of flickers. For example, the foregoing three frame periods or more may be the still image display frame periods Ts1 to Ts3.

In Example 1, the drive circuit 20 performs intermittent stopping of the display drive in the display period of the still image "B" alternately on the pixels 11 belonging to the foregoing odd-numbered lines and the pixels 11 belonging to the even-numbered lines, on a foregoing pixel group unit basis (on a scan line WSL basis). Details of this will be described below.

Specifically, first, the drive circuit 20 performs the display drive in the first frame period, such as the still image display frame period Ts1, within the display period of the still image "B", similarly to Comparative Example 2. The image signal 21A is thereby written into the pixels 11 (see P21 in Part (B) of FIG. 6). In this case, the drive circuit 20 performs such display drive for both the odd-numbered rows and the even-numbered rows, namely, for all of the scan rows similarly to Comparative Example 2. As a result, the still image "B" is displayed on the display panel 10.

Thereafter, the light-emission luminance is gradually lowered with time due to the leakage current described above (see Part (C) of FIG. 6). It is to be noted that the entire surface luminance (Example 1 and Comparative Example 2) is lowered at a different rate from both the odd-numbered row luminance and the even-numbered row luminance (Example 1). One reason for this is as follows. Each of the odd-numbered row luminance and the even-numbered row luminance is obtained from half (½) the number of pixels 11 compared with that of the entire surface luminance. Therefore, each of the odd-numbered row luminance and the even-numbered row luminance is lowered at a half rate. Namely, the downward gradient of each of the odd-numbered row luminance and the even-numbered row luminance is equal to a half that of the entire surface luminance. In other words, the sum of the odd-numbered row luminance and the even-numbered row luminance in Example 1 is nearly equal to the entire surface luminance in Example 1. This relationship is also applicable to the following description.

Thereafter, in the second and third frame periods (the still image display frame periods Ts2 and Ts3), the drive circuit 20 stops perform stopping of the display drive for all of the scan rows (on both the odd-numbered rows and the even-numbered rows), similarly to Comparative Example 2 (see P22 in Part (B) of FIG. 6). As a result, both of the light-emission luminance continuously lowered due to the leakage current (see Part (C) of FIG. 6).

Thereafter, in the fourth frame (the still image display frame period Ts4), the drive circuit 20 performs the display drive only for the odd-numbered rows, unlike Comparative Example 2 (see P24*o* in Part (B) of FIG. 6). Thus, a partial (selective) refresh operation is performed on the pixels 11 belonging to the odd-numbered rows in the display panel 10. As a result, the odd-numbered row luminance increases to some degree (see P23*o* in Part (C) of FIG. 6). The entire surface luminance also increases by amount of this increase in the odd-numbered row luminance (see an arrow P231 in Part (C) of FIG. 6). In this way, it is possible to suppress lowering of the light-emission luminance which is attributed to the leakage current.

In the still image display frame period Ts4, the drive circuit 20 also keep performing stopping of the display drive for the even-numbered rows (see Part (B) of FIG. 6). Therefore, the even-numbered row luminance is continuously lowered due to the leakage current (see Part (C) of FIG. 6).

In the technique in Comparative Example 2 described above, the display drive is performed for all of the scan rows (on both the odd-numbered rows and the even-numbered rows) in the still image display frame period Ts4 (see P204 in Part (B) of FIG. 6). Therefore, as described above, the drive circuit 20 performs the collective refresh operation on all of the pixels 11 in the display panel 10. In this case, the collective stopping of the display drive is performed for three frame periods (the still image display frame periods Ts1 to Ts3) or more. Accordingly, under the foregoing precondition set in this example, the variation in luminance (a difference in luminance), in other words, the occurrence of flickers due to an increase in the entire surface luminance (see the arrow P203 in Part (C) of FIG. 6) is visually perceived by humans.

In contrast, an amount of an increase in the entire surface luminance in Example 1 (see the arrow P231 in Part (C) of FIG. 6) is equivalent to an amount of an increase in the odd-numbered row luminance (see P23*o* in Part (C) of FIG. 6), as described above. Therefore, the entire surface luminance in Example 1 increases less than that in Comparative Example 2. More specifically, in this example, the amount of the increase in the entire surface luminance in Example 1 is about a half that in Comparative Example 2 (see the arrow P203 in Part (C) of FIG. 6). As a result, the occurrence of flickers due to this variation in luminance is not visually perceived by humans.

Thereafter, in the fifth frame period (the still image display frame period Ts5), the drive circuit 20 performs the display drive only for the even-numbered rows, unlike Comparative Example 2 (see P24*e* in Part (B) of FIG. 6). Thus, the partial refresh operation is performed on the pixels 11 belonging to the even-numbered rows in the display panel 10. As a result, the even-numbered row luminance increases to some degree (see P23*e* in Part (C) of FIG. 6). The entire surface luminance also increases by an amount of this increase in the even-numbered row luminance (see the arrow P232 in Part (C) of FIG. 6). In this way, it is possible to suppress lowering of the light-emission luminance which is attributed to the leakage current.

It is to be noted that, in the still image display frame period Ts5, the drive circuit 20 performs stopping of the display drive again for the odd-numbered rows (see Part (B) of FIG. 6). Therefore, the odd-numbered row luminance is lowered again due to the leakage current (see Part (C) of FIG. 6).

The amount of the increase in the entire surface luminance in Example 1 (see the arrow P232 in Part (C) of FIG. 6) is equivalent to the amount of the increase in the even-numbered row luminance (see P23*e* in Part (C) of FIG. 6), as described above. Accordingly, an occurrence of flickers due to the increase in the entire surface luminance in Example 1 at this time is not visually perceived by humans either.

Afterward, in Example 1, the display operation to display the still image "B" is repeatedly performed in a cycle including the operation performed in the still image display frame periods Ts2 to Ts5.

In the present embodiment, as described above, the drive circuit 20 performs the intermittent stopping of the display drive, thereby reducing drive power consumption, which is consumption of electric power necessary for the display drive performed in the display period of the still image. Further, the foregoing intermittent stopping of the display drive is performed for the respective pixel groups (for example, on the respective scan rows) independently of each other. This suppresses an occurrence of flickers which is attributed to the intermittent stopping of the display drive. In other words, this makes less visible the occurrence of flickers which is attributed to the intermittent stopping of the display drive. It may be preferably possible to avoid the occurrence of flickers, or to make the occurrence of flickers to be unperceivable by humans.

In the foregoing present embodiment, the intermittent stopping of the display drive is performed for the respective pixel groups independently of each other in the display period of the still image. This makes it possible to reduce the drive power consumption in the display period of the still image, and to suppress the occurrence of flickers attributed to the intermittent stopping of the display drive. Accordingly, it is possible to achieve reduction in power consumption while suppressing the lowering of display image quality.

Moreover, suppressing such an occurrence of flickers makes it possible to elongate the period of performing the intermittent stopping of the display drive (to increase the number of frames) upon displaying the still image, compared with that in Comparative Example 2 described above. This also makes it possible to achieve reduction in power consumption.

2. MODIFICATION

Next, some modifications (Modifications 1 and 2) of the foregoing embodiment will be described. Constituent elements that are the same as those in the embodiment will be denoted with identical characters and will not be further described where appropriate.

Modification 1

Figure 7:
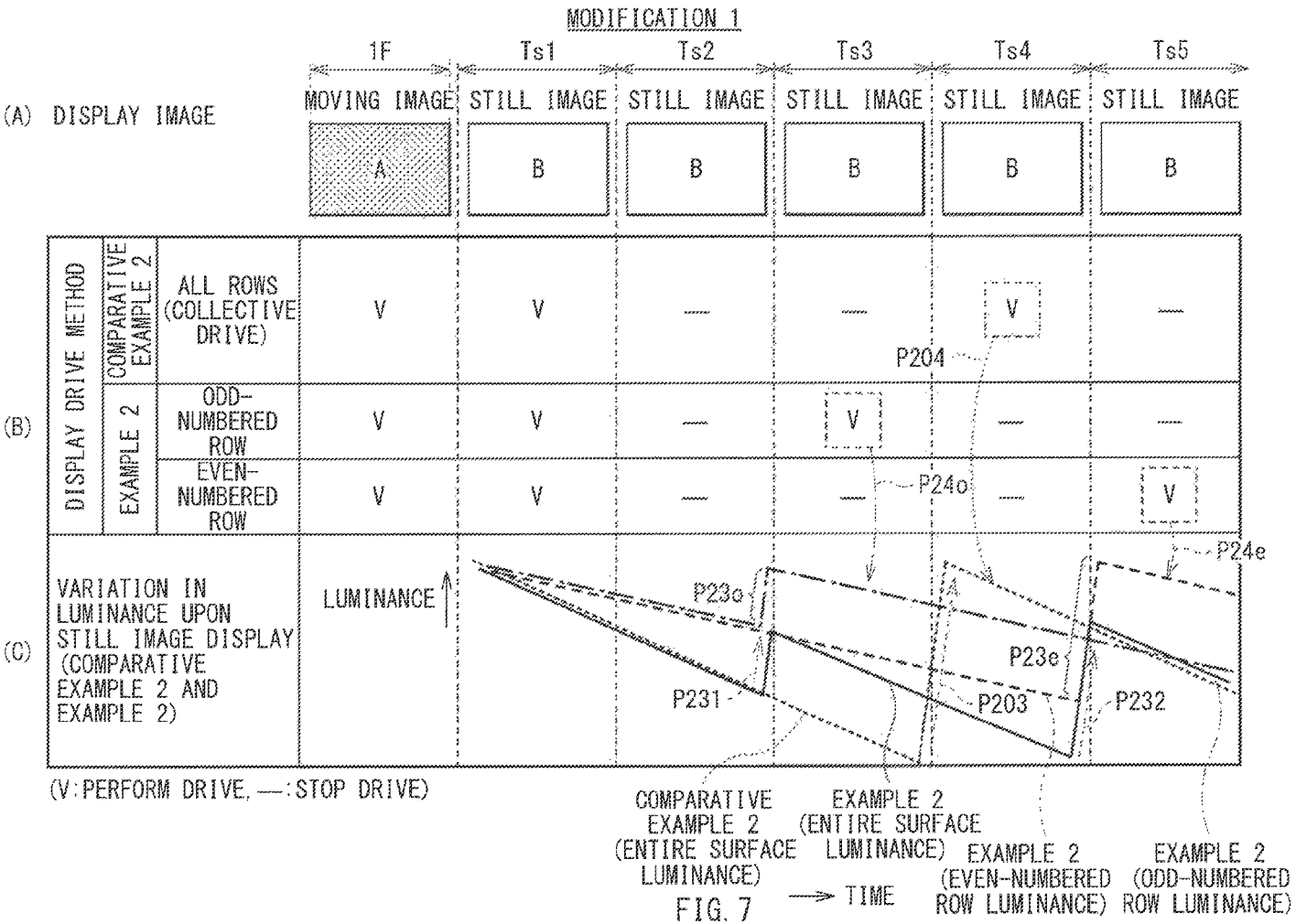
FIG. 7 is a timing diagram schematically illustrating an exemplary display drive operation, according to Example 2 in Modification 1, upon displaying a still image.

FIG. 7 is a timing diagram schematically illustrating display drive operations, according to Example 2 in Modification 1 and to Comparative Example 2 described above, upon displaying the still image, in comparison with each other. Specifically, Part (A) of FIG. 7 schematically illustrates a change with time in a display image in the display panel 10. Part (B) of FIG. 7 schematically illustrates display drive methods according to Comparative Example 2 and Example 2 used in the respective period in which an image is displayed, in comparison with each other. Part (C) of FIG. 7 illustrates variations with time in light-emission luminances of the organic EL devices 12 in the display period of the still image according to Comparative Example 2 and Example 2.

Similarly to Example 1, the illustration in each of Part (B) and Part (C) of FIG. 7 related to Example 2 differentiates the odd-numbered scan lines WSL located in the respective odd-numbered rows and the scan lines WSL located in the respective even-numbered rows from each other. Specifically, the illustration in Part (B) of FIG. 7 differentiates the display drive method used for the odd-numbered rows and the display drive method used for the even-numbered rows from each other. The illustration in Part (C) of FIG. 7 differentiates the foregoing light-emission luminance of the odd-numbered rows and the foregoing light-emission luminance of the even-numbered rows from each other. Furthermore, the illustration in Part (C) of FIG. 7 also includes the foregoing entire surface luminance. It is to be noted that, similarly to Part (C) of FIG. 6 described above, Part (C) of FIG. 7 illustrates only the entire surface luminance for Comparative Example 2.

Also in this example, images displayed in the respective frame periods change in order as the moving image "A", the still image "B", the still image "B", the still image "B", the still image "B", and the still image "B", as illustrated in Part (A) of FIG. 7.

Also in the example of FIG. 7, preconditions are preset as follows. When the drive circuit 20 performs collective stopping of the display drive for two frame periods in total, in other words, when the drive circuit 20 performs stopping of the display drive on all of the pixels 11 for two frame periods in total, it is assumed that humans visually perceive no occurrence of flickers described above. For example, the foregoing two frame periods may be the still image display frame periods Ts1 and Ts2. When the drive circuit 20 performs collective stopping of the display drive for three frame periods or more in total, it is assumed that humans visually perceive the occurrence of flickers. For example, the foregoing three frame periods or more may be the still image display frame periods Ts1 to Ts3.

Example 2 corresponds to Example 1 according to the embodiment described above except for that the timings of performing the intermittent stopping of the display drive for the odd-numbered rows and the even-numbered rows in the display period of the still image "B" are changed. More specifically, the drive circuit 20 so adjusts a first timing and a second timing independently of each other that the display drive in the display period of the still image "B" is performed on all of the pixels 11 as a whole in the display panel 10 in a constant cycle. The first timing is a timing at which the intermittent stopping of the display drive is performed for the odd-numbered rows. The second timing is a timing at which the intermittent stopping of the display drive is performed for the even-numbered rows.

More specifically, as illustrated in Part (B) of FIG. 7, in Example 2, the display drive is performed intermittently for the odd-numbered rows in the still image display frame periods Ts1, Ts3, and so on, and the display drive is performed intermittently for the even-numbered rows in the still image display frame periods Ts1, Ts5, and so on. As a result, the display drive is intermittently performed on the pixels 11 as a whole in the display panel 10 in the still image display frame periods Ts1, Ts3, Ts5, and so on. In other words, a region (scan rows) in which the display drive is performed is present alternately (or periodically) on a frame period basis in the display period of the still image "B", in the pixels 11 as a whole in the display panel 10. In this way, according to Example 2, the drive circuit 20 so adjusts the first timing and the second timing independently of each other that the display drive is performed intermittently for the odd-numbered rows or the even-numbered rows in a constant cycle, unlike Example 1 described above.

Performing the display drive as in Example 2 reduces an amount of a variation (an amount of an increase) in the entire surface luminance in the display period of the still image "B" (see the arrow P231 in Part (C) of FIG. 7), in comparison with Example 1 (see the arrow P231 in Part (C) of FIG. 6). This makes it possible to make the occurrence of flickers due to the variation in luminance at this time to be further less likely to be perceived by humans. Accordingly, in the present modification, it is possible to suppress lowering of display image quality further more than in the foregoing embodiment. In other words, in the present modification, it is possible to improve display image quality further more than in the foregoing embodiment.

Modification 2

Configuration

Figure 8:
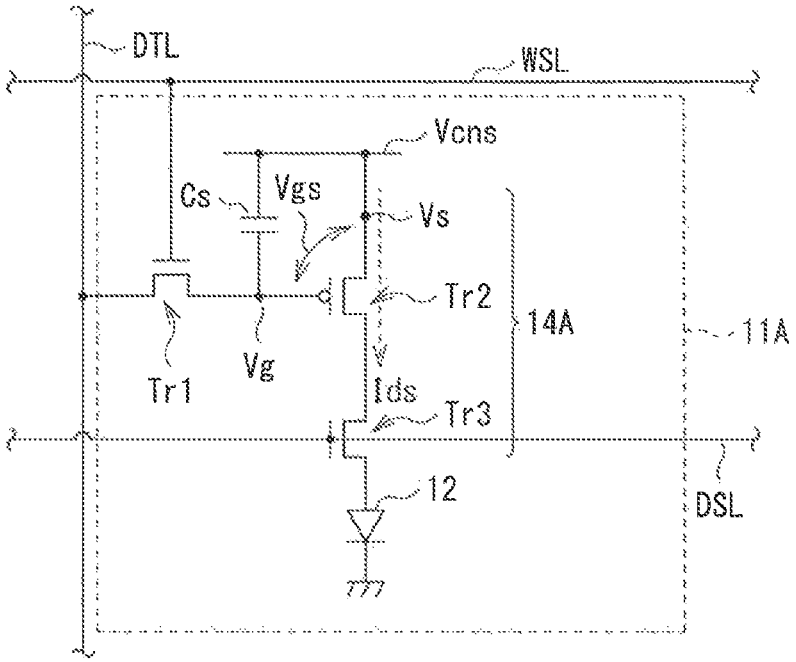
FIG. 8 is a circuit diagram illustrating an exemplary internal configuration of each pixel according to Modification 2.

FIG. 8 is a circuit diagram illustrating an exemplary internal configuration of each pixel (each pixel 11A) according to Modification 2. The pixel 11A in Modification 2 corresponds to the pixel 11 described referring to the embodiment (FIG. 2) except for that the pixel 11A includes a pixel circuit 14A described below instead of the pixel circuit 14. The pixel circuit 14A differs from the pixel circuit 14 in further including a light-emission control transistor Tr3 disposed (inserted) between the drain of the drive transistor Tr2 and the anode of the organic EL device 12. Other configurations are substantially the same as each other. The light-emission control transistor Tr3 may correspond to a "light-emission control switch" in one specific but non-limiting example embodiment of the disclosure.

The light-emission control transistor Tr3 serves as a switching device that controls a light-emission period of the organic EL device 12, details of which will be described below. In this example, the light-emission control transistor Tr3 may be an n-channel MOS TFT, for example. As illustrated in FIG. 8, the light-emission control transistor Tr3 has a gate coupled to the power line DSL. In addition, the light-emission control transistor Tr3 has a source coupled to the anode of the organic EL device 12 and a drain coupled to the drain of the drive transistor Tr2. In the present modification, the power line DSL is coupled to the gate of the light-emission control transistor Tr3 in the pixel circuit 14A. In accordance therewith, both the source of the drive transistor Tr2 and a second end of the capacitor Cs are set at a fixed potential Vcns, unlike the pixel circuit 14.

(Operation, Workings, and Effects)

Figure 9:
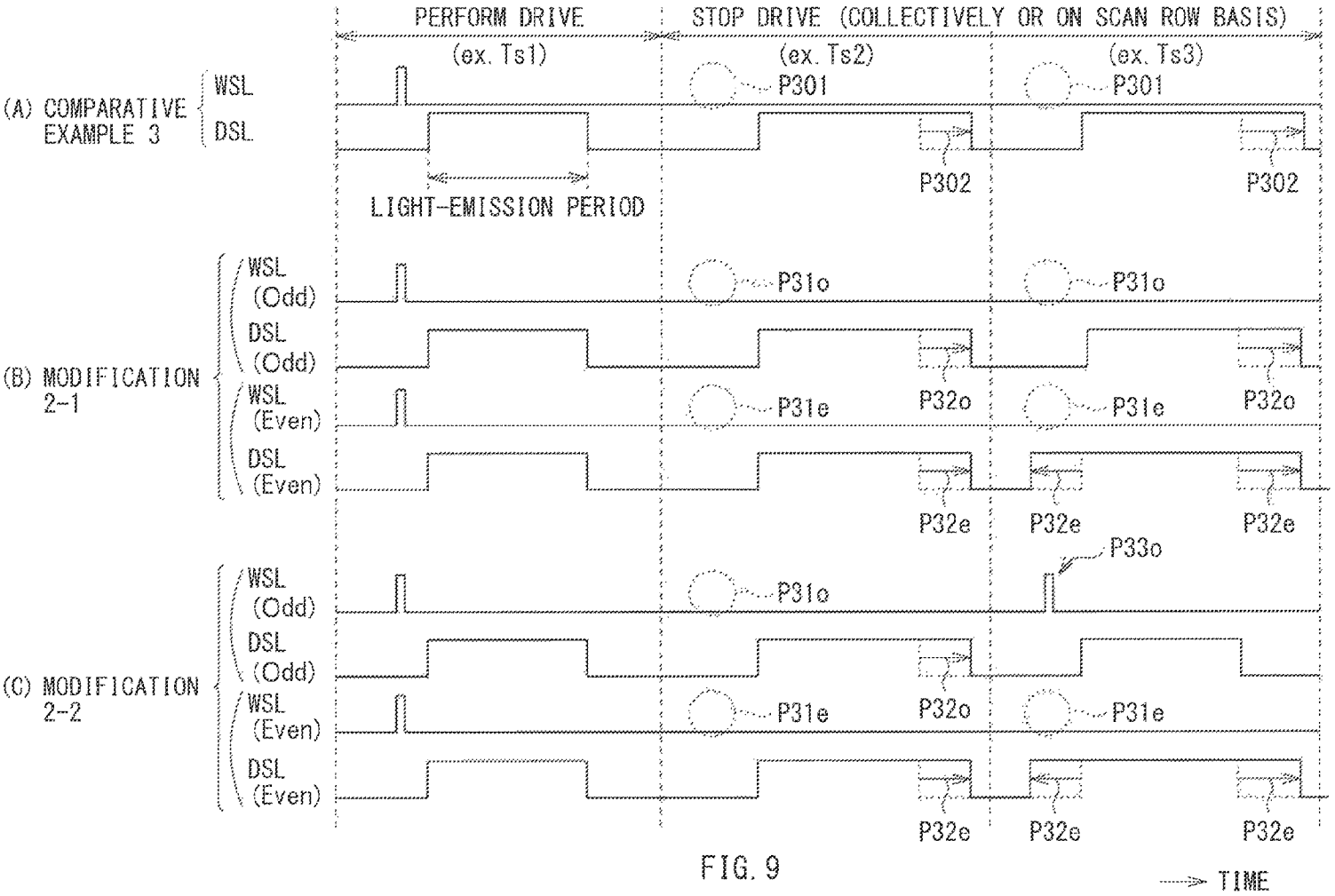
FIG. 9 is a timing diagram schematically illustrating an exemplary display drive operation according to Comparative Example 3 and Modification 2.

FIG. 9 is a timing diagram schematically illustrating an exemplary display drive operations according to each of Modifications 2-1 and 2-2, and that according to Comparative Example 3 in comparison with each other. Specifically, Part (A) of FIG. 9 illustrates timing waveforms of the scan line WSL and the power line DSL in Comparative Example 3. Part (B) of FIG. 9 illustrates timing waveforms of the scan lines WSL and the power lines DSL in Modification 2-1. Part (C) of FIG. 9 illustrates timing waveforms of the scan lines WSL and the power lines DSL in Modification 2-2. In each of Parts (B) and (C) of FIG. 9, the scan line WSL (Odd) and the power line DSL (Odd) denote, respectively, the foregoing scan line WSL located in the odd-numbered row and the power line DSL located in the odd-numbered row. Likewise, the scan line WSL (Even) and the power line DSL (Even) denote, respectively, the foregoing scan line WSL located in the even-numbered row and the power line DSL located in the even-numbered row.

The scan line WSL (Odd) may correspond to an "odd-numbered scan line" in one specific but non-limiting embodiment of the disclosure. The scan line WSL (Even) may correspond to an "even-numbered scan line" in one specific but non-limiting embodiment of the disclosure.

In Comparative Example 3 illustrated in Part (A) of FIG. 9, when the execution period of the display drive (for example, the foregoing still image display frame period Ts1) is compared to the stopping period of the display drive (for example, the foregoing still image display frame periods Ts2, Ts3, etc.), it is found that an operation of the display drive is set in the following manner. It is to be noted that the stopping of the display drive in this example refers to any of the collective stopping performed for the entire surface as in Comparative Example 2 described above and the partial stopping (performed on the scan row unit basis, etc.) as in Examples 1 and 2 described above.

Specifically, in Comparative Example 3, the ON period of the power line DSL is set to be relatively longer in the stopping period of the display drive (see P301 in Part (A) in FIG. 9) in which the application of the selection pulse is stopped, than in the execution period of the display drive (see the arrow P302 in Part (A) in FIG. 9). As can be appreciated from FIG. 8, the ON period of the power line DSL corresponds to the ON period of the light-emission control transistor Tr3, i.e., the light-emission period of the organic EL device 12. Accordingly, in Comparative Example 3, the operation of the display drive is so set that the light-emission period is relatively longer than the execution period of the display drive in the stopping period of the display drive. As a result, in Comparative Example 3, the lowering of the light-emission luminance due to the foregoing leakage current upon stopping of the display drive is suppressed by adjusting the light-emission period (by elongating the light-emission period). More preferably, the light-emission luminance may be kept constant.

In each of Modifications 2-1 and 2-2, the drive circuit 20 utilizes the adjustment operation of the light-emission period with the light-emission control transistor Tr3, to thereby performs the operation as follows upon stopping the display drive. Specifically, the drive circuit 20 so controls ON periods of the light-emission control transistors Tr3 for the respective pixel groups (in this example, for the respective scan rows) independently of each other that the light-emission period becomes relatively longer in the stopping period of the display drive. More specifically, in this example, the drive circuit 20 performs, with the light-emission control transistor Tr3, the adjusting operation of the light-emission period in the display drive stopping period for the odd-numbered rows and the even-numbered rows independently from each other. For example, the drive circuit 20 may perform, with the light-emission control transistor Tr3, the adjusting operation of the light-emission period in the display drive stopping period to be different for the odd-numbered rows and the even-numbered rows independently from each other.

More specifically, Modification 2-1 illustrated in Part (B) of FIG. 9 involves the following setting. First, for the odd-numbered row, the ON period of the power line (Odd) is set to be relatively longer in a time-axis direction (see the arrow P32*o*) in the stopping period of the display drive (see P31*o*) in which the application of the selection pulse to the scan line WSL (Odd) is stopped. In contrast, for the even-numbered rows, the ON period of the power line DSL (Even) is set, by the following technique, to be relatively longer (see the arrow P32*e*) in the stopping period of the display drive (see P31*e*) in which the application of the selection pulse to the scan line WSL (Even) is stopped. In other words, for the power line DSL (Even), in the first frame period within the stopping period of the display drive, the ON period is extended only in the time-axis direction (in one direction), similarly to the case of the odd-numbered row. However, in the second frame period within the stopping period of the display drive, the ON period is extended in the time-axis direction and its opposite direction (in both directions), unlike the case of the odd-numbered row.

Modification 2-2 illustrated in Part (C) of FIG. 9 differs from Modification 2-1 in the operation performed for the odd-numbered row in the second frame period within the stopping period of the display drive. More specifically, in the second frame period, the drive circuit 20 performs the display drive for the odd-numbered row (see the character P33*o*), although not performing the display drive for the even-numbered row. In response to this, the drive circuit 20 does not perform the adjusting operation of the light-emission period using the light-emission control transistor Tr3.

According to Modifications 2-1 and 2-2, as described above, the control of the ON period of the light-emission control transistors Tr3 is so performed for the respective pixel groups (in this example, on the respective scan rows) independently of each other that the light-emission period is relatively longer in the stopping period of the display drive. This may achieve the following effects, for example. That is, the suppressing of the lowering of the light-emission luminance due to the leakage current utilizing the adjusting operation of the light-emission period (elongating the light-emission period) described above referring to Comparative Example 3 is controllable for the respective pixel groups independently of each other. Accordingly, it is possible to suppress lowering of display image quality also in the present modification. Further, it is also possible to elongate the stopping period of the display drive upon displaying the still image (to increase the number of frames), and to thereby achieve reduction in power consumption.

The technique in Modifications 2-1 and 2-2 (the adjusting operation of the light-emission period using the light-emission control transistor Tr3) may be used either in combination with or instead of the technique in the foregoing embodiment, Modification 1, Modification 2, etc.

3. EXEMPLARY APPLICATIONS

Next, a description will be given of an exemplary application of the display unit according to any of the foregoing embodiment, Modification 1, and Modification 2 to an electronic apparatus.

Figure 10:
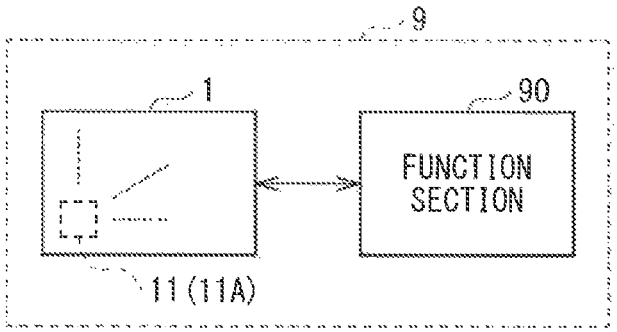
FIG. 10 is a block diagram illustrating an exemplary outline configuration of an electronic apparatus according to an exemplary application.

FIG. 10 is a block diagram illustrating an exemplary outline configuration of an electronic apparatus (an electronic apparatus 9) according to the present exemplary application. The electronic apparatus 9 may include the display unit 1 and a function section 90. The display unit 1 includes the plurality of pixels 11 (or the plurality of pixels 11A) described above. The function section 90 allows for execution of various functions of the electronic apparatus 9 itself.

Examples of the electronic apparatus 9 may include any of various mobile devices. Examples of such mobile devices may include an electronic book, a laptop personal computer (PC), a tablet, a portable game device, a portable audio player, a portable video player, a portable phone, and a wearable terminal. However, the electronic apparatus 9 is not limited to these mobile devices. Alternatively, the electronic apparatus 9 may also be a TV appliance (a TV receiver), a lighting apparatus, a digital signage, or a car navigation system, for example.

4. OTHER MODIFICATIONS

The technology of the disclosure has been described above referring to the foregoing embodiment, the modifications thereof, and the exemplary applications thereof. However, the technology is not limited to the foregoing embodiment, the modifications thereof, and the exemplary applications thereof, and is variously modifiable.

For example, the exemplary configurations of the display unit and the electronic apparatus in the embodiment, modifications, and exemplary applications have been described. However, the technology is not limited to these configurations, and various modifications may be made. Specifically, for example, a portion of these exemplary configurations may be replaced with another configuration, or each exemplary configuration may further include an additional configuration. Moreover, shapes, arrangements, the quantities, etc. of constituent elements in the embodiment, the modifications, and the exemplary applications are not limiting. Alternatively, the other shapes, arrangements, and quantities of constituent elements may be employed.

More specifically, for example, the display unit in the foregoing embodiment, etc. is of an active matrix type; however, the configuration of the pixel circuit for the active-matrix drive is not limited to those described in the embodiment, the modifications, etc. For example, the configuration of the pixel circuit is not limited to the "2Tr1C" circuit configuration in the foregoing embodiment, the modifications, etc. Alternatively, a capacitor, a transistor, and some other elements may be added or replaced on as-needed basis. In this case, the modified pixel circuit may further include any necessary drive circuit in addition to the scan line drive circuit 23, the signal line drive circuit 24, and the power line drive circuit 25 described in the foregoing embodiment, the modifications, etc.

In the foregoing embodiment, the modifications, etc., the timing generating circuit 22 controls the drive operation of each of the scan line drive circuit 23, the signal line drive circuit 24, and the power line drive circuit 25; however, another circuit may control this drive operation. Furthermore, each of the scan line drive circuit 23, the signal line drive circuit 24, and the power line drive circuit 25 may be controlled by either hardware such as a circuit or software such as a program.

In the foregoing embodiment, the modifications, etc., an organic EL device (organic electroluminescence light emitting device) may be used as an example of the "light emitting device" in one specific but non-limiting embodiment of the disclosure; however, this light emitting device is not limited to the organic EL device. Specifically, any light emitting devices other than the organic EL device may be used as a constituent element of a display unit. Examples of such light emitting devices may include an inorganic EL device, an LED (light emitting diode), and a laser device.

In the foregoing embodiment, the modifications, etc., each of the write transistor Tr1 and the light-emission control transistor Tr3 in the pixel circuit is an n-channel transistor (n-channel MOS TFT), and the drive transistor Tr2 is a p-channel transistor (p-channel MOS TFT). However, configurations of the write transistor Tr1, the drive transistor Tr2, and the light-emission control transistor Tr3 are not limiting. Any channel types (conductivity types) of transistors may be used in combination in accordance with a purpose or application, for example.

A technique of performing the display drive upon displaying the still image is not limited to those described in the foregoing embodiment, the modifications, etc. Alternatively, any other technique may be used. Specifically, as one example, in the foregoing embodiment, the modifications, etc., the drive circuit 20 performs the intermittent stopping of the display drive alternately for the odd-numbered rows and the even-numbered rows. However, the technique of performing the display drive is not limiting. Alternatively, for example, the drive circuit 20 may sequentially perform the intermittent stopping of the display drive for three or more types of scan rows. Moreover, the pixels belonging to one scan row is not necessarily set as a pixel group. Alternatively, the pixels belonging to a plurality of scan rows may be set as a pixel group. Moreover, a region in which the individual pixel group is set is not necessarily associated with the scan row. Alternatively, for example, the regions in which the individual pixel group is set may be associated with other control lines, such as the signal lines DTL. Alternatively, any pixel region may be set as a pixel group.

Some examples described above may be applied in any combination with one another.

The effects described herein are exemplary and thus not limiting, and any other effects may be provided.

It is possible to achieve at least the following configurations from the above-described example embodiments of the disclosure.

(1)

A display unit including:

a plurality of pixels each including a light emitting device, a transistor, and a capacitor; and a drive circuit that writes an image signal into each of the pixels and thereby performs display drive, the pixels as a whole being dividable into a plurality of pixel groups, and the drive circuit performing intermittent stopping of the display drive for the respective pixel groups independently of each other in a still image display period based on the image signal.

(2)

The display unit according to (1), wherein each of the pixel groups includes more than one, of the pixels, that are disposed along one or more scan lines, and the drive circuit performs the intermittent stopping of the display drive in the still image display period for the respective one or more scan lines independently of each other.

(3)

The display unit according to (2), wherein the drive circuit performs the intermittent stopping of the display drive in the still image display period alternately for more than one, of the pixels, that are disposed along one or more odd-numbered scan lines and more than one, of the pixels, that are disposed along one or more even-numbered scan lines, the one or more odd-numbered scan lines each being one of the scan lines that is located at an odd-numbered position, and the one or more even-numbered scan lines each being one of the scan lines that is located at an even-numbered position.

(4)

The display unit according to (3), wherein the drive circuit adjusts timings of performing the intermittent stopping of the display drive for the one or more odd-numbered scan lines and the one or more even-numbered scan lines independently of each other, and thereby causes the display drive in the still image display period to be performed in a constant cycle on the pixels as a whole.

(5)

The display unit according to any one of (1) to (4), wherein each of the pixels is coupled to a scan line on which application of a selection pulse used to sequentially select the pixels is performed and is coupled to a signal line to which the image signal is supplied, and the drive circuit stops the application of the selection pulse performed on the scan line and thereby stops the display drive.

(6)

The display unit according to (5), wherein each of the pixels further includes a light-emission control switch that controls a light-emission period of the light emitting device, and the drive circuit performs a control of an ON-period of the light-emission control switch for the respective pixel groups independently of each other, and thereby causes the light-emission period to be relatively longer while the display drive is stopped.

(7)

The display unit according to any one of (1) to (6), wherein the light emitting device is an organic electroluminescence light emitting device.

(8)

An electronic apparatus with a display unit, the display unit including:

a plurality of pixels each including a light emitting device, a transistor, and a capacitor; and a drive circuit that writes an image signal into each of the pixels and thereby performs display drive, the pixels as a whole being dividable into a plurality of pixel groups, and the drive circuit performing intermittent stopping of the display drive for the respective pixel groups independently of each other in a still image display period based on the image signal.

Although the invention has been described in terms of exemplary embodiments, it is not limited thereto. It should be appreciated that variations may be made in the described embodiments by persons skilled in the art without departing from the scope of the invention as defined by the following claims. The limitations in the claims are to be interpreted broadly based on the language employed in the claims and not limited to examples described in this specification or during the prosecution of the application, and the examples are to be construed as non-exclusive. For example, in this disclosure, the term "preferably", "preferred" or the like is non-exclusive and means "preferably", but not limited to. The use of the terms first, second, etc. do not denote any order or importance, but rather the terms first, second, etc. are used to distinguish one element from another. The term "substantially" and its variations are defined as being largely but not necessarily wholly what is specified as understood by one of ordinary skill in the art. The term "about" or "approximately" as used herein can allow for a degree of variability in a value or range. Moreover, no element or component in this disclosure is intended to be dedicated to the public regardless of whether the element or component is explicitly recited in the following claims.

What is claimed is:

1. A display unit comprising:

a plurality of pixels each including a light emitting device, a transistor, and a capacitor; and a drive circuit configured to write an image signal into each of the pixels to perform a display drive, the pixels forming a plurality of pixel groups, and the drive circuit performing intermittent stopping of the display drive for respective ones of the pixel groups independently of each other in a still image display period based on the image signal, wherein each of the pixel groups includes more than one of the pixels disposed along one or more scan lines, the drive circuit performs the intermittent stopping of the display drive in the still image display period for one or more of the scan lines independently of each other, the drive circuit performs the intermittent stopping of the display drive in the still image display period alternately for more than one of the pixels disposed along one or more odd-numbered scan lines and more than one of the pixels disposed along one or more even-numbered scan lines, the one or more odd-numbered scan lines being at one or more odd-numbered scan line positions, and the one or more even-numbered scan lines being at one or more even-numbered scan line positions, and the drive circuit adjusts timings of performing the intermittent stopping of the display drive for the one or more odd-numbered scan lines and the one or more even-numbered scan lines independently of each other to cause the display drive in the still image display period to be performed in a constant cycle on the pixels as a whole.

2. The display unit according to claim 1, wherein each of the pixels is coupled to one of the scan lines on which application of a selection pulse is used to sequentially select the pixels and is coupled to a signal line to which the image signal is supplied, and the drive circuit is configured to stop the application of the selection pulse on the scan line and to stop the display drive.

3. The display unit according to claim 2, wherein each of the pixels further includes a light-emission control switch that controls a light-emission period of the light emitting device, and the drive circuit performs a control of an ON-period of the light-emission control switch for the respective pixel groups independently of each other.

4. The display unit according to claim 1, wherein the light emitting device is an organic electroluminescence light emitting device.

5. An electronic apparatus with a display unit, the display unit comprising:

a plurality of pixels each including a light emitting device, a transistor, and a capacitor; and a drive circuit configured to write an image signal into each of the pixels to perform display drive, the pixels forming a plurality of pixel groups, and the drive circuit performing intermittent stopping of the display drive for the respective pixel groups independently of each other in a still image display period based on the image signal, wherein each of the pixel groups includes more than one of the pixels disposed along one or more scan lines, the drive circuit performs the intermittent stopping of the display drive in the still image display period for one or more of the scan lines independently of each other, the drive circuit performs the intermittent stopping of the display drive in the still image display period alternately for more than one of the pixels disposed along one or more odd-numbered scan lines and more than one of the pixels disposed along one or more even-numbered scan lines, the one or more odd-numbered scan lines being at one or more odd-numbered scan line positions, and the one or more even-numbered scan lines being at one or more even-numbered scan line positions, and the drive circuit adjusts timings of performing the intermittent stopping of the display drive for the one or more odd-numbered scan lines and the one or more even-numbered scan lines independently of each other to cause the display drive in the still image display period to be performed in a constant cycle on the pixels as a whole.

6. The electronic apparatus according to claim 5, wherein each of the pixels is coupled to one of the scan lines on which application of a selection pulse is used to sequentially select the pixels and is coupled to a signal line to which the image signal is supplied, and the drive circuit is configured to stop the application of the selection pulse on the scan line and to stop the display drive.

7. The electronic apparatus according to claim 6, wherein each of the pixels further includes a light-emission control switch that controls a light-emission period of the light emitting device, and the drive circuit performs a control of an ON-period of the light-emission control switch for the respective pixel groups independently of each other.

8. The electronic apparatus according to claim 5, wherein the light emitting device is an organic electroluminescence light emitting device.

* * * * *